United States Patent [19]

Kärkkäinen et al.

[11] Patent Number: 4,487,414

[45] Date of Patent: Dec. 11, 1984

[54] COIN OPERATED PRIZE DISPENSING PROJECTING GAME

[75] Inventors: Martti Kärkkäinen, Espoo; Lauri Martti, Helsinki, both of Finland

[73] Assignee: Raha-Automaattiyhdistys, Helsinki, Finland

[21] Appl. No.: 459,609

[22] PCT Filed: May 26, 1982

[86] PCT No.: PCT/FI82/00018

§ 371 Date: Jan. 7, 1983

§ 102(e) Date: Jan. 7, 1983

[87] PCT Pub. No.: WO82/04340

PCT Pub. Date: Dec. 9, 1982

[30] Foreign Application Priority Data

Jun. 1, 1981 [FI] Finland ..... 811687

[51] Int. Cl.[3] ..... A63F 9/02; G07F 17/38

[52] U.S. Cl. ..... 273/371; 273/379; 273/399

[58] Field of Search ..... 273/357, 371, 399, 405, 273/121 E, 379, 402

[56] References Cited

U.S. PATENT DOCUMENTS

| | | | |
|---|---|---|---|
| 1,866,063 | 7/1932 | Sloan | 273/144 B |
| 2,847,221 | 8/1958 | Collins et al. | 273/399 |
| 4,303,248 | 12/1981 | Shoemaker | 273/357 X |

FOREIGN PATENT DOCUMENTS

| | | | |
|---|---|---|---|
| 751091 | 6/1933 | France | 273/371 |
| 351860 | 8/1937 | Italy | 273/405 |

*Primary Examiner*—Anton O. Oechsle

[57] ABSTRACT

A slot machine or coin operated prize dispensing apparatus comprising a vertical gambling panel which forms a plane of movement for coins or similar flat, rolling tokens and which is provided with a plurality of prize sensors located in the plane of movement, a projector adjacent the plane of movement, a stake inserting slot, and a pay-out mechanism. A closed circulating path for projected coins is formed in the plane of movement of the gambling panel and passes adjacent the projector. The stake inserting slot is connected past the gambling panel to the pay-out panel by means of a separate circulating path for stake coins. Thus, the projected coins are independent of the number, value and combination of the stake coins so that the game can be priced and the prize relation changed without touching the projected coins.

4 Claims, 3 Drawing Figures

COIN OPERATED PRIZE DISPENSING PROJECTING GAME

Figure 1:
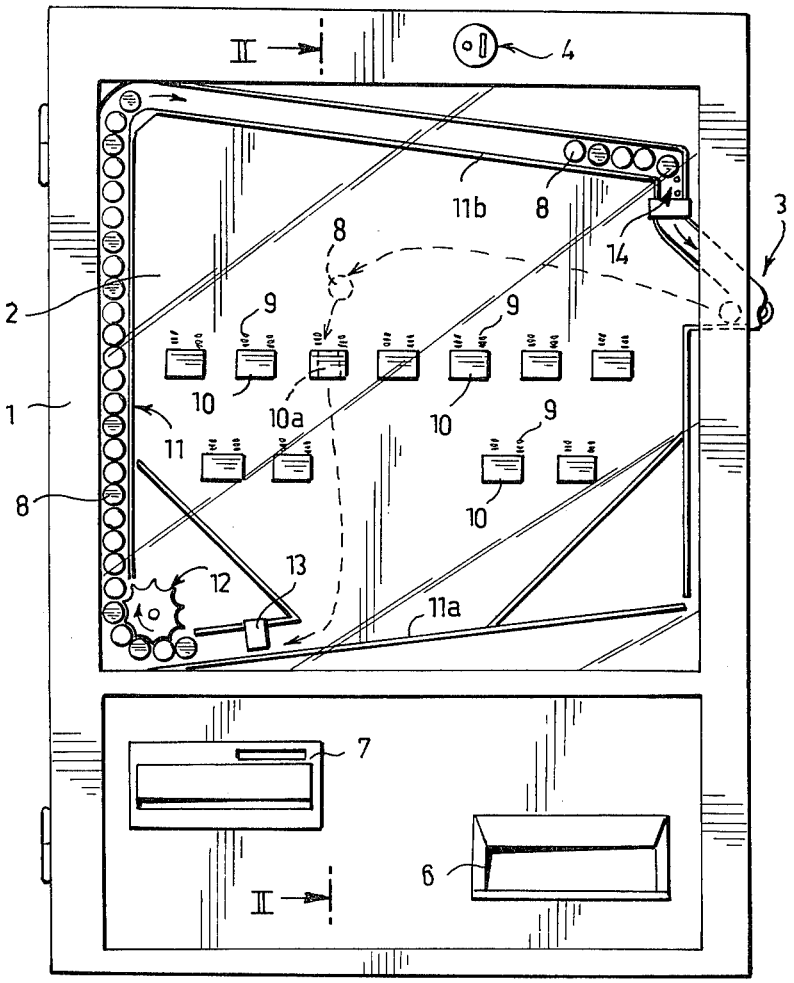

The present invention relates to a slot machine comprising a vertical gambling panel which forms a plane of movement for coins or similar flat, rolling tokens and which is provided with a plurality of prize sensors located in the plane of movement, a hitting means adjacent the plane of movement of the gambling panel, an inserting means for stakes and a pay-out mechanism.

Slot machines of this type have been used for years in various public locations. Their operation is based upon the principle that a coin dropped through the inserting means into the hitting means has by actuation of the hitting means been hit along the front surface of the gambling panel. The player tries to hit the coin so that it passes through a prize opening in the gambling panel to the back side of the gambling panel where it acts on the pay-out mechanism for dispensing prize coins out of the slot machine. A coin that has not reached a prize opening drops along the front surface of the gambling panel into a coin store, from which said prize coins are dispensed, or into a cashbox.

In this known slot machine a coin inserted expressly into the slot machine is thus actually hit to pass along the gambling panel, and the coins remaining in the gambling panel are thus continuously changed. From this follows that the slot machine will accept as stakes only a coin of a certain value, for example, a 50 penny coin, wherefore the price of the game must always be of the same value as this coin. One further disadvantage is that a coin passing through the prize opening must be transferred from the front side of the gambling panel to the rear side thereof, i.e. it must move in a direction perpendicular to the plane of the coin. This involves the risk that the coin may get stuck when moving from the first plane of movement to a second plane of movement. Still one disadvantage is that the value of the prize must always be equal to the value of said coin to be dropped into the slot machine or a multiple thereof.

It is an object of the present invention to provide a slot machine which avoids the above-mentioned disadvantages. This object is achieved by means of a slot machine according to the invention which is characterized in that a closed circulating path for gambling coins is formed in the plane of movement of the gambling panel, said path passing through the hitting means, and that the inserting means for stake coins is connected past the gambling panel to the pay-out mechanism by means of a separate circulating path for stake coins.

The slot machine according to the invention is based on the idea that the same gambling coins continuously circulate in the gambling panel, while stake coins inserted into the slot machine do not at all reach the gambling panel but by-pass said panel into the cashbox or pay-out mechanism of the slot machine. Thus, the gambling coins moving in the gambling panel need not be similar to the stake coins inserted into the slot machine. This provides the possibility of arranging the price of the game independent of the value of the gambling coins in the gambling panel (e.g., 50 pennies) and to set the price of the game as the sum of stake coins of different values, e.g., 1.20 marks. Because no gambling coins need be removed from the gambling panel, there is also no need to displace the gambling coins in the axial direction. Instead, said coins always move in one and the same plane each in its turn from the hitting means along the same gambling panel and back to the hitting means. In addition, the size of the prize can be set to be independent of the value of the gambling coins circulating in the gambling panel and the size of the prize can be selected to be the sum of stake coins of different values inserted in the machine, e.g., 2.40 marks. Due to such an independence between the coins circulating in the gambling panel and the coins used as stakes the slot machine can be made electronic in which case the various functions are controlled by a microprocessor. In such a slot machine also banknotes can be accepted as stakes in addition to coins.

Figure 2:
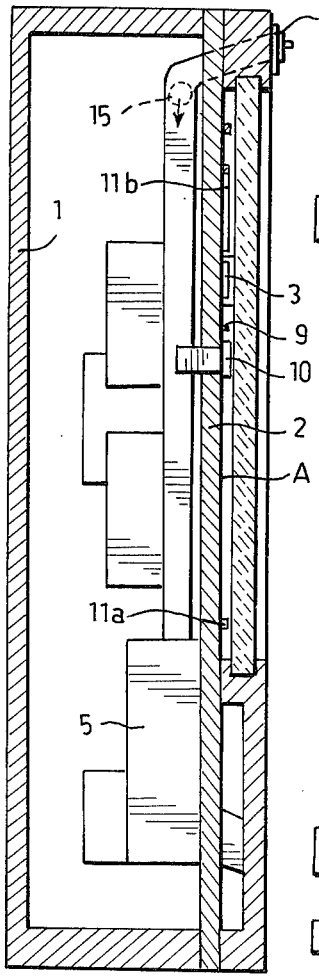
Figure 3:
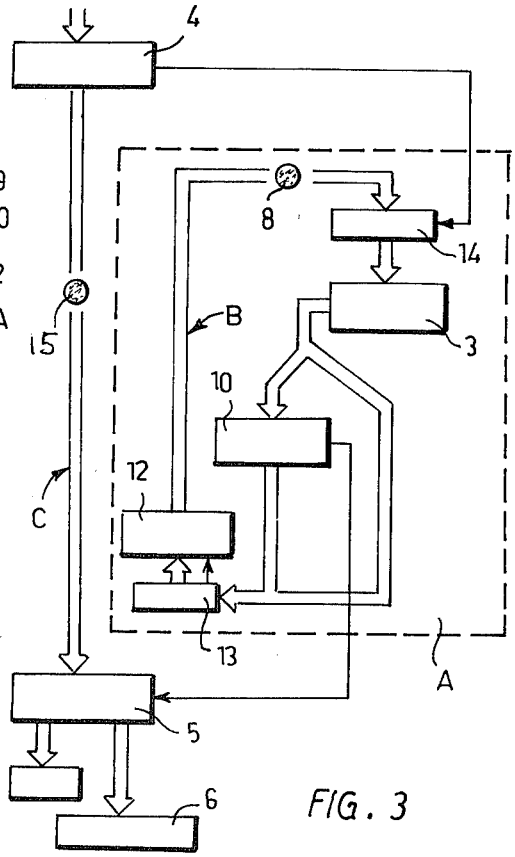

The invention will be described in more detail in the following with reference to the accompanying drawings, in which FIG. 1 is a front view of a preferred embodiment of a slot machine according to the invention, FIG. 2 is a vertical section of the slot machine along the line II—II in FIG. 1, and FIG. 3 shows the operation diagram of the slot machine.

The slot machine shown in the drawings comprises a box-shaped frame 1 having an openable front side made of glass. Inside the frame is fastened a vertical gambling panel 2 and to one side thereof a hitting means 3. To the upper part of the frame is fastened an inserting means 4 communicating with a pay-out mechanism (see FIG. 3) fastened to the frame. In the lower part of the frame are mounted a prize trough 6 and a banknote identifying means 7. The elements 3, 4, 5, 6 and 7 are commercially available units known per se wherefore their operation and construction will not be described in more detail.

The front side of the gambling panel forms a plane of movement A for gambling coins 8, such as metal coins, tokens or any other flat rolling pieces. A plurality of spaced-apart ports 9 extend horizontally across the gambling panel. Underneath each port is mounted a prize sensor 10 provided with a through opening 10*a* located in the plane of movement of the gambling panel. A second port-sensor-row is mounted underneath the upper port-sensor-row. The prize sensors may comprise, for example, commercially available units which are known per se from coin counters or coin sorters and which operate on the light diode/light transistor principle.

To the lower side, the left-hand vertical side and the upper side of the gambling panel are fastened guides 11 which form a channel for gambling coins which guides said coins in a continuous row from the lower part of the gambling panel to the upper part thereof. The lowermost guide 11*a* is inclined towards a lift wheel 12 in front of which a sensor 13 is located. The uppermost guide 11*b* is inclined towards a dispenser 14 and further towards the hitting means 3.

The slot machine operates in the following manner. (For the sake of clarity, all actuating elements which are unessential to the invention, such as the coin identifying means and the various control and verifying means, the illuminating means, and similar have been omitted):

Having reference to FIG. 3, a gambler drops a stake coin 15 into the inserting means 4 which gives an impulse to the dispenser 14 to drop a gambling coin 8 into the hitting means 3. The stake coin passes on to the pay-out mechanism 5 and from there to the cashbox 5' or the prize trough 6 of the slot machine as a function of interception or not of the gambling coin 8 by the prize sensors 10.

The gambler hits a gambling coin from the hitting means into the gambling panel. When falling downwards said coin either by-passes all ports 9 or passes through one of the ports and the corresponding prize sensor 10. When the gambling coin passes through a port and is guided into a prize sensor, the sensor gives an impulse to the pay-out mechanism for dispensing a winning amount of stake coins through the prize trough 6 corresponding to the prize sensor. Hereupon, the gambling coin falls down onto the lowermost guide 11*a* and rolls past the sensor 13 to the lift wheel 12. The sensor gives an impulse to the driving mechanism of the lift wheel to rotate the lift wheel forwards a distance corresponding to one coin. The lift wheel then lifts the stack of coins and the uppermost gambling coin rolls along the uppermost guide 11*b* into the dispenser 14.

In case a stake coin dropped into the inserting means entitles according to its value, for example, to two games, the dispenser 14 has in the meanwhile dropped a second gambling coin into the hitting means 3.

It will be noted that all gambling coins 8 circulate along a closed path B through the hitting means 3, the lift wheel 12, the guides 11, the dispenser 14 and, depending of how the game proceeds, possibly also through a port 9 and a prize sensor 10. The stake coins 15, on the contrary, pass along a separate and independent path C defined between the inserting means 4 and the pay-out mechanism 5. Thus, as seen in FIG. 3, the stake coins move along path C from the inserting means 4 to the pay-out mechanism 5 and from the pay-out mechanism to either the prize trough 6 or to the cash-box as a function of interception or not of the gambling coin 8 by the prize sensors 10. This makes the gambling coins independent of the number, value and combinations of the stake coins (e.g., coins of different values) which permits pricing of the game and changing of the prize relation without touching the gambling coins. In the same way as the inserting means 4 for stake coins is connected to give an impulse or impulses to the dispenser 14, the banknote identifying means 7 may be connected to control the operation of the dispenser.

The drawings and the description related thereto are only intended to illustrate the idea of the invention. In its details the slot machine according to the invention may vary considerably within the scope of the claims.

We claim:

1. A slot machine comprising a plurality of first coin means of predetermined fixed number, a vertical gambling panel defining a first planar closed path for circulating said plurality of first coin means therein, said first planar closed path including hitting means for hitting one of said first coin means, and a plurality of prize sensors for intercepting said one of said first coin means hit by the hitting means; second coin means different from said first coin means, coin receiving means for receiving said second coin means for commencing operation of the slot machine on receiving predetermined amounts of said second coin means, and a second path different from said first path and being from said coin receiving means directly to a pay-out mechanism operatively connected to a prize trough and a cash box as a function of interception or not of the first coin means by the prize sensors, said plurality of first coin means only being circulated in said first planar closed path for supply at least one at a time to said hitting means in said first path as a function of deposit of said second coin means in said coin receiving means, said prize sensors being connected to said pay-out mechanism and providing an impulse to said pay-out mechanism when one of said first coin means is received by one of the prize sensors, said pay-out mechanism paying out said second coin means through said prize trough on receipt of said impulse or releasing the second coin means to said cash box in the absence of said impulse.

2. The machine of claim 1, wherein guide means is provided for guiding the plurality of first coin means within said closed path, said guide means including downwardly inclined lower and upper sections for downward movement of said first coin means in said closed path, said lower and upper sections being interconnected by a vertical section provided at its lower end portion with sensor means for moving said plurality of first coin means upwardly for advancing said first coin means one at a time from the upper end of the vertical section into said upper downwardly inclined section of said guide means.

3. The machine of claim 2, wherein said means for moving said plurality of first coin means upwardly comprises a sensor and a lift wheel, the sensor sensing passage of the first coin means down the downwardly inclined lower section of the guide means after being hit by said hitting means and providing an impulse for driving the lift wheel a distance corresponding to a single coin.

4. The machine of claim 1, wherein the prize sensors are provided with a through-opening for said first coin means in the plane of movement of the first coin means whereby the first coin means pass through each prize sensor without being deflected from its plane of movement.

* * * * *